US006237305B1

(12) United States Patent
Landers

(10) Patent No.: US 6,237,305 B1
(45) Date of Patent: May 29, 2001

(54) PROCESS FOR IN-SITU TREATMENT OF WOOD POLES

(76) Inventor: Phillip G. Landers, 250 Power Ct., Sanford, FL (US) 32779

( * ) Notice: Subject to any disclaimer, the term of this patent is extended or adjusted under 35 U.S.C. 154(b) by 0 days.

(21) Appl. No.: 09/480,352

(22) Filed: Jan. 10, 2000

(51) Int. Cl.[7] ..... E04B 1/00; E04B 21/00; E04B 23/00

(52) U.S. Cl. ..... 52/741.14; 52/169.14; 156/94

(58) Field of Search ..... 52/514, 514 S

(56) References Cited

U.S. PATENT DOCUMENTS

| | | | | |
|---|---|---|---|---|
| Re. 35,322 | * | 9/1996 | Owen et al. | 52/741.14 |
| 4,283,219 | * | 8/1981 | Wagner et al. | 71/28 |
| 4,892,601 | * | 1/1990 | Norwood | 156/94 |
| 5,691,383 | * | 11/1997 | Thomas et al. | 514/594 |
| 6,089,351 | * | 8/2000 | Mills | 52/169.14 |

OTHER PUBLICATIONS

Hawley's Condensed Chemical Dictionary, Sax, Irving N., 1987, Van Nostrand Reinhold Company Inc., Eleventh Edition, 19, 659,873,935.*

* cited by examiner

*Primary Examiner*—Carl D. Friedman
*Assistant Examiner*—Steve M Varner
(74) *Attorney, Agent, or Firm*—William M. Hobby, III

(57) ABSTRACT

A method for in-situ treatment of wood utility poles includes excavating an area around the base of a wood pole supported in the earth and drilling a plurality of holes in the wood pole for injecting an isophorone containing compounds thereinto. A preselected coating is used to coat a portion of the pole adjacent the excavated area with a preselected compound containing an isophorone solvent and then covering the coated portion of the pole with a covering wrap prior to refilling the excavated area around the wooden pole for treating the pole in-situ for preventing decay. The selected coating material can include an isophorone solvent formulated with a wax and an acrylic resin. The method also includes drilling any portion of a utility pole and injecting an isophorone compound thereinto to disperse the remaining creosote or pentachlorophenol in a treated utility pole.

16 Claims, 1 Drawing Sheet

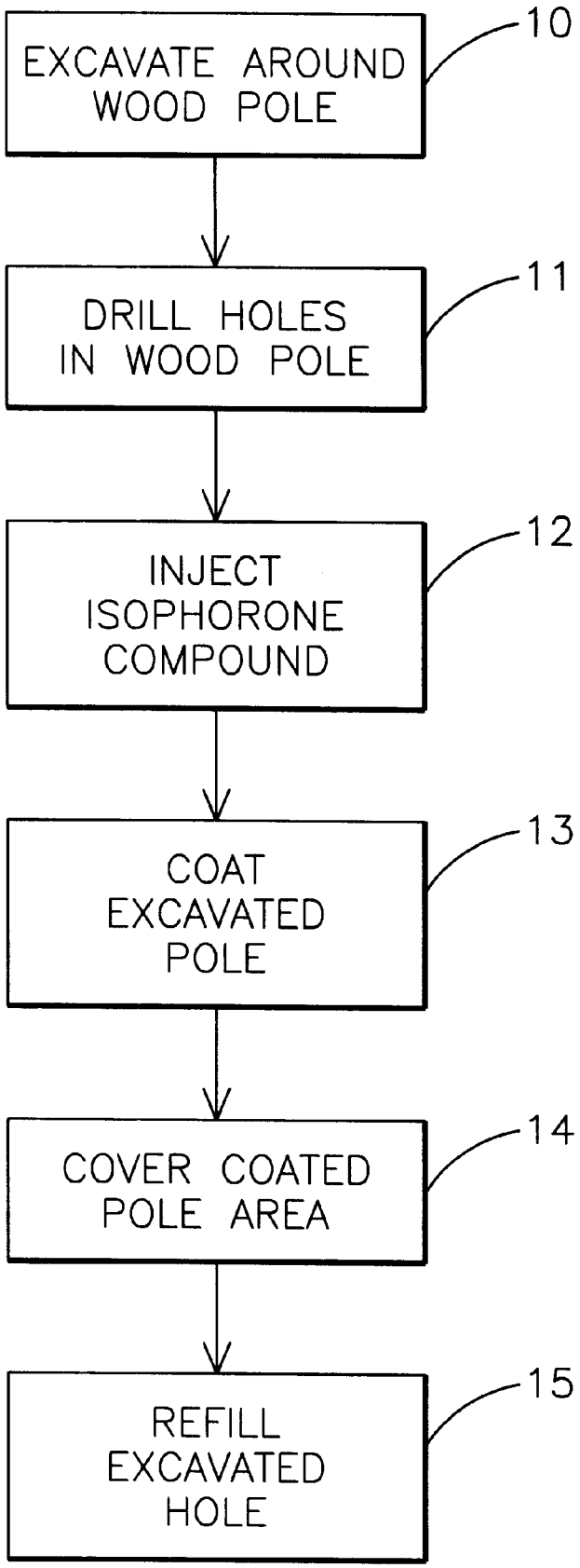
EXCAVATE AROUND WOOD POLE
10
DRILL HOLES IN WOOD POLE
11
INJECT ISOPHORONE COMPOUND
12
COAT EXCAVATED POLE
13
COVER COATED POLE AREA
14
REFILL EXCAVATED HOLE
15

PROCESS FOR IN-SITU TREATMENT OF WOOD POLES

BACKGROUND OF THE INVENTION

The present invention relates to a process for in-situ treatment of wood poles and especially to the treatment of wooden utility poles against deterioration.

Wood poles make up a substantial percentage of poles used in transmission and distribution of electricity throughout the world. Since wood is a natural material, it is susceptible to deterioration by decay organisms especially at the ground line where the wood pole is supported in the earth. To extend the life of wooden utility poles, the poles are pressure treated before installation with volatile chemicals, such as creosote, pentachlorophenol, and various combinations of arsenic salts and the like. Even though wooden poles are treated under pressure, the depth of penetration of the chemicals is typically limited to the outside two or three inches of the pole. The wooden poles were once living trees and contain living decay organisms or fungi that remain in the interior untreated section of the pole even after treatment. When the wood pole is placed in the ground, natural weathering allows these decay organisms to flourish resulting in the formation of voids in the wood and thus a loss of structural integrity of the pole. This is especially true within the poles adjacent the ground lines where the poles enter the earth since the poles in the earth tend to absorb and accumulate moisture in the base which encourages the growth of fungi and other decay organisms. Typical methods used to arrest this decay include the application of highly toxic chemicals and fumigants that are injected into the void area created by the decay organisms. In addition, biocides are painted on the outside of the pole below the ground line to prevent additional undesirable organisms from entering the wood from the soil.

The present invention is a method for arresting wood pole decay and pole ground line decay in an existing utility pole which has previously been treated. This is accomplished by sealing the wood and reactivating the existing preservative by using an injection treatment of an isophorone solvent into poles drilled into the base of the pole and by coating the base of the pole with an isophorone formulated paint. The painted area of the pole may also be covered with a moisture impenetrable polymer film for sealing the outside of a base pole from the ground line. Since isophorone migrates through moisture, it is necessary to provide a moisture barrier to keep it from escaping into the moist soil.

One prior patent to Tomlinson, Sr. et al., U.S. Pat. No. 4,414,227, teaches a method for repelling birds, especially woodpeckers, from selected areas or surfaces which comprises applying isophorone in such areas or surfaces. Isophorone is an organic solvent that has been found effective in repelling the woodpeckers and has a molecular structure that is highly miscible in water.

The present invention deals with an isophorone formulated chemical coating and sealant for coating the ground line area of an existing pressure treated utility pole and to a process which drills holes in the utility pole for injecting an isophorone compound thereinto in those poles previously pressure treated with an oil-based preservative, such as creosote or pentachlorophenol. Tests have shown that the composition when applied in accordance with the present process has been found effective in arresting further decay within the poles.

SUMMARY OF THE INVENTION

A method for in-situ treatment of wood utility poles includes excavating an area around the base of a wood pole supported in the earth and drilling a plurality of holes in the wood pole for injecting an isophorone containing compounds thereinto. A preselected coating is used to coat a portion of the pole adjacent the excavated area with a preselected compound containing an isophorone solvent and then covering the coated portion of the pole with a covering wrap prior to refilling the excavated area around the wooden pole for treating the pole in-situ for preventing decay. The selected coating material can include an isophorone solvent formulated with a wax and an acrylic resin. The method also includes drilling any portion of a utility pole and injecting an isophorone compound thereinto to disperse the remaining creosote or pentachlorophenol in a treated utility pole.

BRIEF DESCRIPTION OF THE DRAWINGS

Other objects, features, and advantages of the present invention will be apparent from the written description and the drawings in which:

FIG. 1 is a flow diagram of the process of the present invention.

DESCRIPTION OF THE PREFERRED EMBODIMENT

Wood poles consists of a complex structure of linear fibers that carry moisture-laden nutrient from the roots to its highest canopy of the tree. When used as a pole, gravity also uses this linear fiber structure to carry the chemical preservative down the vertically standing pole into its base. Thus, a reservoir of preservative is formed in the pole especially in the lower portion of the pole that if directed into decay affected areas, is ample to arrest further decay.

Isophorone has been found to be highly effective water-misable, low volatility solvent that migrates easily through an aqueous medium. Isophorone has also been found to effectively liquify certain types of wood preservatives, especially creosote and pentachlorophenol, both of which are oil-dispersed treatments. I have conducted tests in which an isophorone solution was painted on ground-line sections of treated wood poles. Substantial migration of preservative was observed both along and across the woods. The extend of preservative migration was observed to vary with the type of preservative and moisture content in the wood.

Isophorone's movement is based on moisture so that it is necessary to direct its path into the wood and not into the soil. A stretchable plastic film, such as used to wrap pallets, provides an excellent moisture barrier to isophorone. In addition, isophorone can be combined with a wax, acrylic resin, and various thickeners to produce a sealant. Used in combination with the stretchable plastic film, isophorone can be sealed into the wood. Isophorone is technically 3,5,5-trimethyl-2-cyclohexen-one-1 whose physical properties are well known and it is readily available on the open market.

Referring to the drawing, the present process is illustrated in which the first step is the excavation (10) of a hole around an in-service utility wood pole. Once the excavated hole has been made, a plurality of holes are drilled (11) into the pole into any decay cavity that may exist in the pole. An isophorone based sealant is injected (12) through the holes into each cavity. Next an isophorone based paint is selected and formulated which may be the same as isophorone compound injected into the pole. The compound can include an isophorone in combination with an acrylic resin solution of paraffin wax and a clay thickener along with a flocculated silica thickener. The selected isophorone compound is then a thickened paste-like isophorone base paint used to paint

(13) the outside of the wood pole from the ground line to the bottom of the excavation. Once this area of the base has been painted with the isophorone based paint, it is next wrapped (14) with a stretchable polymer film around the painted portion of the pole generally below the ground line and then the hole is filled (15) to complete the treatment of the pole.

The preferred composition includes 70–80% Isophorone (3,5,5-trimethyl-2-cyclohexen-one-1); 8–20% acrylic resin solution; 5–10% paraffin wax; and 4–8% of a clay thickener and 1–2% of a flocculated silica thickener. The composition of material is made up with a method which includes heating a mixture of wax and Isophorone to a temperature above the melting point of the wax and then blending with a high speed mixer the heated mixture with water and hydrophobic clay. The blending mixture is cooled to ambient temperature and has an acrylic resin blended thereinto to form a composition for coating and sealing wood.

EXAMPLE

A specific formula includes 77.5% Isophorone, 10% solution acrylic resin, 5.6% of paraffin wax, 5.3% of a clay thickener, and 1.6% of a flocculated silica thickener. The Isophorone is obtained from Union Carbide while the acrylic resin is obtained from Rohm and Haas under their formula Acryloid B-66. Paraffin wax is obtained from the International Group, Inc., Item #1260. The clay thickener is Claytone APA from Southern Clay Products and the flocculated silica thickener is Degusa Aerosil 200. The paraffin wax is heated to melt it and then combined with the Isophorone and, while heated, the clay thickener and the flocculated silica thickener are added to the mixture which is blended together. The composition is allowed to cool to ambient temperature and the solution acrylic resin is added to the cooled mixture.

This composition has been found to have a high penetration into the wood being treated and, by the application of varying degrees of pressure, increases the penetration to extend the life of the preservative in the wood. Both the paraffin wax and the isophorone are relatively insoluble in water but the heated combination of the paraffin wax and isophorone has been found to allow the addition of water with the hydrophobic clay when the clay is added to the hot liquid with a high speed mixer. The fine clay particles precipitate and gels the isophorone and wax solution and, upon cooling, the resulting solution is a homogenous isophorone and wax solution that is then able to be blended with an acrylic resin to produce the sealant. In addition, polyethylene can be added to the hot liquid isophorone and paraffin wax solution. The sealant/paint is then used to inject into the pole and to the area around the base of the pole below the ground line. The coating is then wrapped with a stretchable polymer film and the excavated area refilled with earth.

The process also includes the selecting a utility pole that has been treated with creosote or pentachlorophenol and which has moisture in the interior which penetrates the pole from the soil and drilling one or a plurality of holes therein. The selected pole is then injected with isophorone or a compound of isophorone through the drilled opening into the interior of the utility pole where over a period of time the isophorone penetrates the wood pole and disperses creosote or pentachlorophenol in the wood pole to thereby reactivate the preservatives in the wood that have migrated from the surface of the wood. The drilled holes are then filled such as with a wooden or epoxy plug which is cured in the opening. It has also been found that a deeper penetration of preservatives in newly treated poles can be obtained by the application of an isophorone to disperse the preservative in the wood pole. Isophorone can also be added to a creosote or a pentachlorophenol composition to enhance its penetration into the wood during the treatment process. The creosote then penetrates deeper into the wood.

It should be clear at this time that a method of arresting wood pole ground line decay is provided by sealing the wood and reactivating the exiting preservatives. However, the present invention is not to be considered as limited to the forms set forth herein as to be considered illustrative rather than restrictive.

I claim:

1. Process for in-situ treatment of wood poles comprising the steps of:

excavating an area around the base of a wood pole supported in the earth;

drilling a hole in said wood pole;

injecting an isophorone containing compound into said drilled hole;

coating a portion of said pole adjacent the excavated area with a preselected compound;

covering said coated portion of said pole with a covering wrap; and refilling the excavated area around said wood pole; whereby a wood pole can be treated in-situ for preventing decay in the wood pole.

2. A process for in-situ treatment of wood poles in accordance with claim 1 including drilling a plurality of holes said wood pole and injecting an isophorone containing compound into each said drilled hole.

3. A process for in-situ treatment of wood poles in accordance with claim 2 in which the step of coating includes coating a wood pole with a paint containing an isophorone solvent.

4. A process for in-situ treatment of wood poles in accordance with claim 3 in which the step of covering includes covering said wood pole portion with a polymer fabric.

5. A process for in-situ treatment of wood poles in accordance with claim 3 in which the step of covering includes covering said wood pole portion with a stretchable polymer fabric.

6. A process for in-situ treatment of wood poles in accordance with claim 4 in which the step of coating includes coating with a coating containing wax, Isophorone and acrylic resin.

7. A process for in-situ treatment of wood poles in accordance with claim 6 in which the step of coating includes coating with a coating containing paraffin wax.

8. A process for in-situ treatment of wood poles in accordance with claim 7 in which the step of coating includes coating with a coating containing polyethylene wax.

9. A process for in-situ treatment of wood poles in accordance with claim 8 in which the step of coating includes coating with a coating containing 70 to 80 percent Isophorone.

10. A process for in-situ treatment of wood poles in accordance with claim 9 in which the step of coating includes coating with a coating containing 8 to 20 percent acrylic resin.

11. Process for in-situ treatment of wood poles comprising the steps of:

selecting a wood pole supported in the earth for treatment;

forming a hole in said wood pole;

injecting an isophorone containing compound into said drilled hole; and refilling the drilled hole in said wood pole; whereby a wood pole can be treated in-situ for preventing decay in the wood pole.

12. Process for in-situ treatment of wood poles in accordance with claim 11 including the step of damping said selected pole with water prior to adding an isophorone containing compound thereinto.

13. Process for in-situ treatment of wood poles in accordance with claim 12 in which the step of forming a hole includes drilling at least one hole into said selected wood pole.

14. Process for in-situ treatment of wood poles comprising the steps of:

selecting a wood pole for treatment;

forming a hole in said selected wood pole;

injecting a wood preservative into said formed hole in said wood pole;

injecting an isophorone containing compound into said formed hole in said wood pole; and filling said formed hole in said wood pole; whereby a wood pole can be treated for preventing decay therein.

15. Process for in-situ treatment of wood poles in accordance with claim 14 in which the step of injecting a wood preservative into said formed hole includes injecting a creosote compound therein.

16. Process for in-situ treatment of wood poles in accordance with claim 14 in which the step of injecting a wood preservative into said formed hole includes injecting a pentachlorophenol compound therein.

* * * * *